United States Patent [19]

McNally et al.

[11] Patent Number: 4,510,776

[45] Date of Patent: Apr. 16, 1985

[54] SLIDING ACCESS DOOR FOR WASHING MACHINE

[75] Inventors: William J. McNally; John C. Mellinger, both of Newton, Iowa

[73] Assignee: The Maytag Company, Newton, Iowa

[21] Appl. No.: 565,730

[22] Filed: Dec. 27, 1983

[51] Int. Cl.[3] ..... D06F 29/02; D06F 39/14

[52] U.S. Cl. ..... 68/3 R; 68/196; 68/20; 220/345; 312/330 R; 312/279

[58] Field of Search ..... 68/3 R, 12 R, 19.2, 68/20, 23 R, 23 A, 26, 139, 196, 212; 220/345; 312/297, 330 R, 279, 273; 49/404

[56] References Cited

U.S. PATENT DOCUMENTS

| | | | |
|---|---|---|---|
| 1,979,361 | 11/1934 | Allman | 68/142 |
| 2,273,998 | 2/1942 | Rueger | 220/345 X |
| 2,276,635 | 3/1942 | Weber | 220/345 |
| 2,732,700 | 1/1956 | Dunn | 68/14 |
| 2,808,153 | 10/1957 | Miller | 68/23 X |
| 2,817,501 | 12/1957 | Schubert | 220/345 X |
| 2,897,035 | 7/1959 | Dorsey | 312/330 R |
| 3,545,235 | 12/1970 | Menk | 68/19.2 |
| 3,611,756 | 10/1971 | Brucken | 68/3 R |

FOREIGN PATENT DOCUMENTS

| | | | |
|---|---|---|---|
| 2303186 | 7/1974 | Fed. Rep. of Germany | 220/345 |
| 69290 | 5/1958 | France | 68/23 |
| 59-2800 | 1/1984 | Japan | 68/3 R |

*Primary Examiner*—Philip R. Coe
*Assistant Examiner*—Frankie L. Stinson
*Attorney, Agent, or Firm*—Richard L. Ward

[57] ABSTRACT

A combination appliance is provided having a washing machine and a separately operable dryer disposed above the washing machine. The washing machine and dryer are separately supported in a generally mating relationship providing the characteristics of a unitary appliance. There is a horizontally disposed top cover associated with the washing machine which defines an access opening to within the washing machine. The top cover also includes guideways at the sides of the access opening with an access door being cooperable with the guideways for sliding movement to close the access opening in a first forward posture and to uncover the access opening in a second rearward posture. The top cover further includes structure for effectively retaining the access door in the guideways in the first forward posture and providing a housing for the access door in the second rearward posture.

6 Claims, 6 Drawing Figures

SLIDING ACCESS DOOR FOR WASHING MACHINE

BACKGROUND OF THE INVENTION

This invention relates generally to the field of stackable laundry appliances and more particularly to providing a non-removable sliding access door for the top cover assembly of the washing machine. The access door of the washing machine is positionable beneath the cabinet of the dryer by sliding the access door in guideways associated with the top cover of the washing machine.

Prior stacked laundry pairs have typically shown a dryer mounted at approximately eye level above a washing machine with the dryer cabinet located so that the washing machine access door can be hinged at the rear and pivoted upwardly and rearwardly beneath the dryer cabinet. In some stacked pairs such as in U.S. Pat. No. 3,545,235, the dryer is mounted directly to the top cover across the rear of the washing machine and the lower portion of the dryer cabinet tapers rearwardly to provide sufficient space for opening a hinged access door.

Allman, in U.S. Pat. No. 1,979,361, shows a horizontal axis washing machine having a cylindrical fabric container. An arcuate cover is slidably arranged between flanges attached to the body of the container. Gaskets are provided for forming a water tight seal between the cover and the container.

Dunn, in U.S. Pat. No. 2,732,700, discloses a wringer washing machine having a removable sliding lid or tray for covering the tub opening during washing. The lid has a downwardly turned lip or flange around its periphery and slides on a shouldered portion of the tub sides. Each side of the lid has a pair of rubber pads for preventing scratching or rattling as the lid slides upon the shouldered portion of the tub sides.

The prior art in the area of sliding access doors for laundry equipment has previously been limited to water sealing, arcuately shaped doors for horizontal axis machines or to a removable sliding lid arrangement for a wringer washing machine for preventing splashing during wash and for hiding a storable wringer assembly. There has been no known showing of a non-removable sliding access door for the washing machine portion of a stacked laundry pair.

SUMMARY OF THE INVENTION

It is therefore an object of the instant invention to provide an improved access door for a washing machine.

It is a further object of the instant invention to provide a sliding access door for the washing machine of a stacked laundry pair which can slide beneath the dryer to provide access to the interior of the washing machine.

It is a still further object of the instant invention to provide a sliding access door which is non-removable when the washing machine is in an operable posture.

Briefly, the instant invention achieves these objects in a top cover assembly for a washing machine. A horizontally disposed top cover is associated with the washing machine and defines an access opening for providing access to within the washing machine. Guideways are located at the sides of the access opening. An access door is cooperable with the guideways for forward and rearward sliding movement to close the access opening in a first forward posture and to uncover the access opening in a second rearward posture. Panel apparatus is provided for limiting movement of the access door and includes a first portion fixed to the top cover generally below the access door and at least partially over the access opening.

Operation of the access door and further objects and advantages thereof will become evident as the description proceeds and from an examination of the accompanying two sheets of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
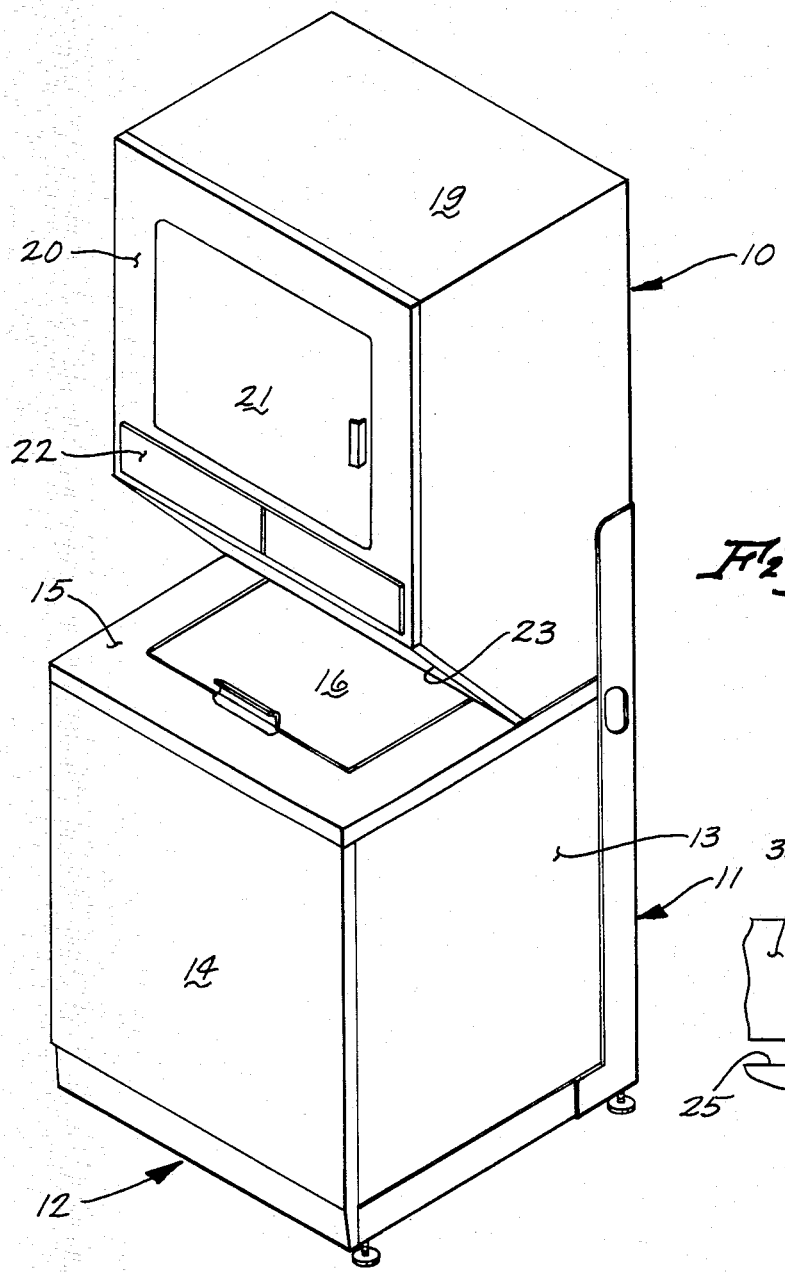
FIG. 1 is an isometric view of a washer/dryer pair mounted in a stack arrangement through a support stand.

Referring now to the drawings and in particular to FIG. 1, there is shown a pair of laundry appliances with a fabric dryer 10 mounted on an appliance support stand 11 above an automatic washing machine 12.

Briefly, in this embodiment of the invention, the automatic washing machine 12 is housed within a generally rectangular cabinet having a three-sided enclosure member 13 forming the sides and rear of the cabinet. A vertically oriented front panel 14 completes the peripheral cabinet of the washing machine 12. The cabinet of the washing machine 12 also includes a substantially horizontally disposed top cover 15 having a slidable access door 16 for providing access to the interior of the washing machine 12.

The fabric dryer 10 is shown mounted in a cantilevered fashion on the support stand 11 directly above the washing machine 12 and also has a substantially rectangular enclosure 19 which is substantially shorter in front-to-back depth than that of the washing machine 12. The vertically oriented dryer front panel 20 includes an access door 21 for loading and unloading fabrics to be dried. Controls, such as control panel 22, may be positioned on the dryer and/or washer through which the washing machine 12 and dryer 10 are controlled. As further shown in FIG. 1, the lower front panel portion 23 of the dryer 10 tapers rearwardly from a point adjacent the bottom edge of the control panel 22. The lower edge of the dryer lower front panel 23 is adjacent to but spaced slightly above the top cover 15 of the washing machine 12.

Figure 4:
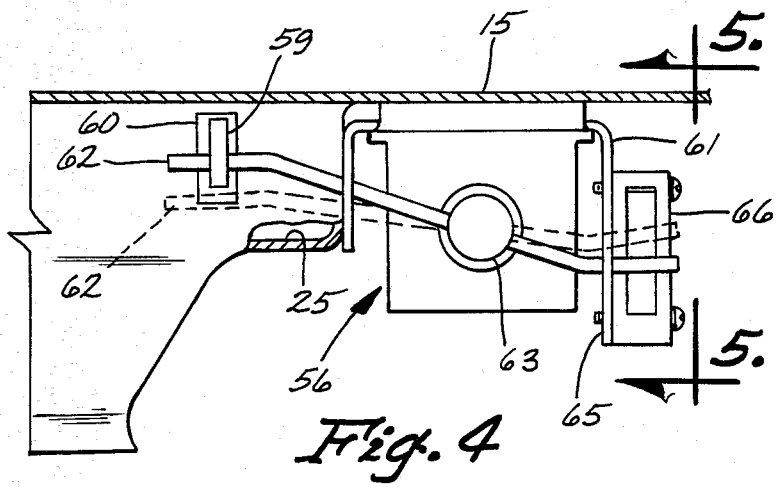
FIG. 4 is a fragmentary section view showing the access door latching arrangement taken generally along lines 4—4 of FIG. 2 and shown out of order on sheet 1.
Figure 2:
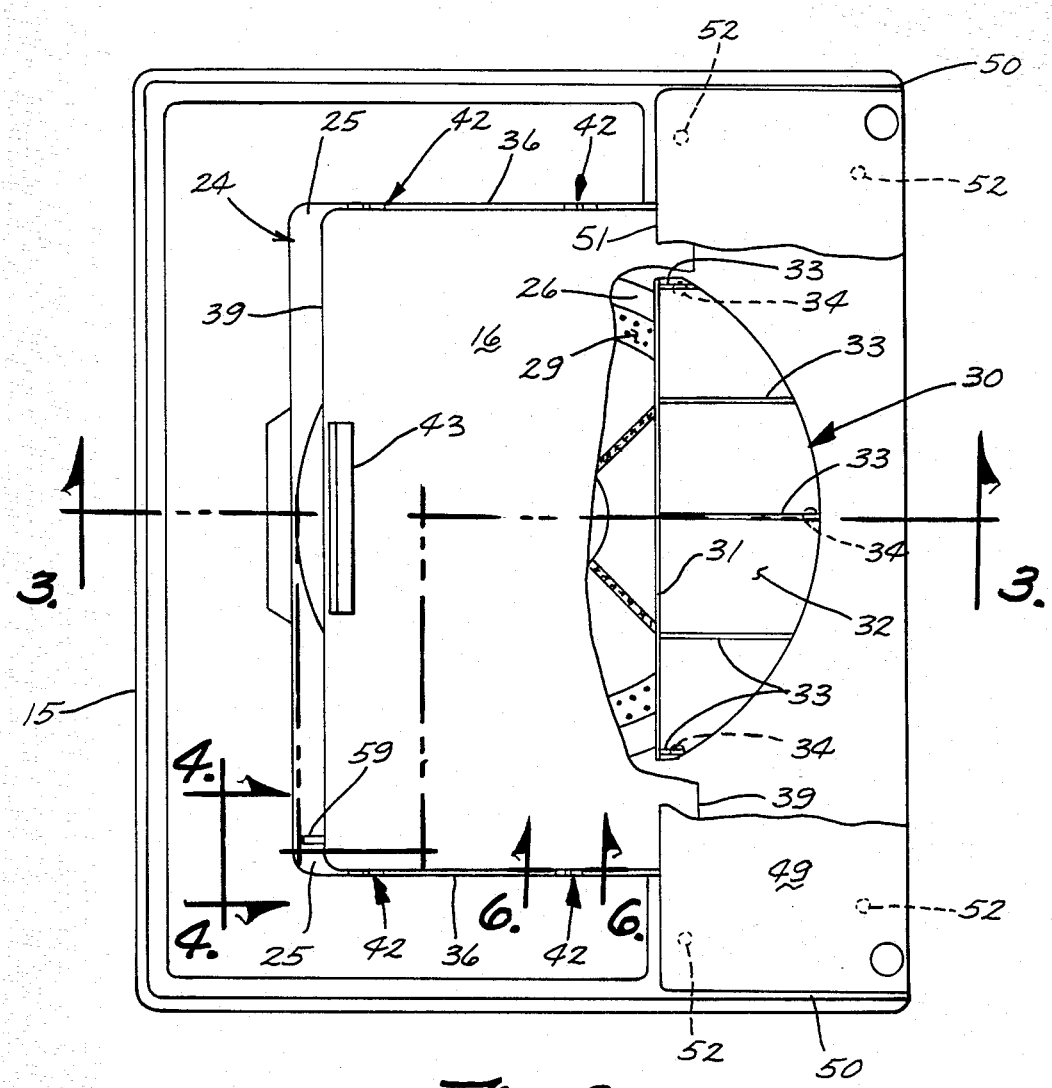
FIG. 2 is a top plan view of the washing machine.
Figure 3:
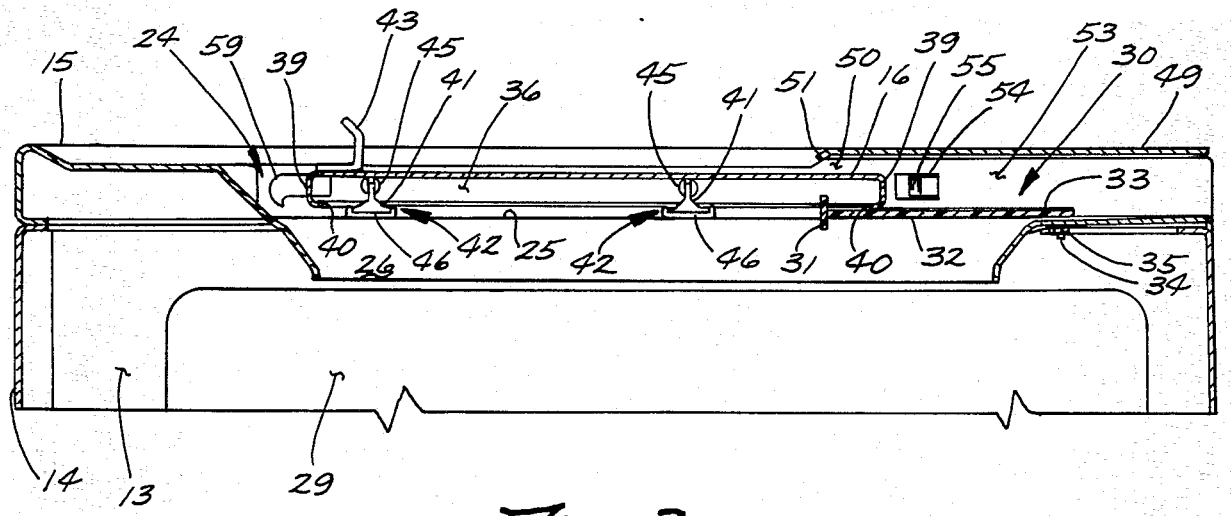
FIG. 3 is a section view of the top portion of the washing machine taken generally along lines 3—3 of FIG. 2.

Referring now to FIGS. 2 and 3, there is shown a top plan view and a cross sectional view of the top cover 15 of the washing machine 12 of FIG. 1. As previously discussed relative to FIG. 1, the top cover 15 completes the enclosure of the washing machine 12 and is generally rectangular in shape. The top cover 15 includes a generally centrally located rectangular depression 24 which has a substantially flat front-to-rear area on either side defining guideways 25, as best shown in FIGS. 3 and 4, for receiving the front-to-rear movable sliding access door 16. The rectangular depression 24 of the top cover 15 extends downwardly into a tapered substantially circular tub access opening 26 for loading and unloading clothing into and out of the tub 29.

In this embodiment of the invention, approximately the rear quarter of the circular tub access opening 26 is covered by a thermoplastic splash guard 30. As best shown in FIG. 2, the splash guard 30 is semicircular in configuration and, as shown in FIG. 3, is substantially flat and of uniform cross section. A front wall 31 extends equally above and below the horizontally disposed body 32 of the splash guard 30. The portion above is engageable by lid lip 40 as a stop in the rearward position and as a stop and fluid seal in the forward position. The body 32 of the splash guard 30 includes a plurality of front-to-rear ribs 33 for strengthing and maintaining flatness. The splash guard 30 also includes a plurality of molded studs 34 which extend downwardly through the top cover 15 and receive threaded fasteners 35 for securing the splash guard 30 to the top cover 15.

Figure 6:
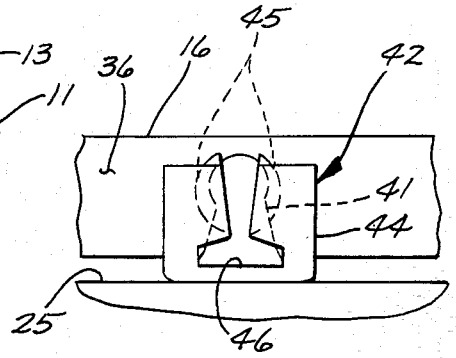
FIG. 6 is a fragmentary section view taken generally along lines 6—6 of FIG. 2 and shown out of order on sheet 1.

As further shown in FIGS. 2 and 3, the sliding access door 16 cooperates with the splash guard 30 to cover the tub access opening 26. The access door 16 is rectangular in shape and is sized to mate with the rectangular depression 24 in the top cover 15. The access door 16 has a substantially flat horizontally disposed top, vertical side walls 36, vertical end walls 39 and a bottom peripheral edge or turned in lip 40. The side walls 36 of the access door 16 each further include a pair of spaced-apart keyhole shaped apertures 41 for receiving thermoplastic glides 42 as best shown in FIGS. 3 and 6. A handle 43 is mounted on top of the access door 16 for manually sliding the access door 16 back and forth along guideways 25 to cover and uncover the tub access opening 26.

The plurality of plastic glides 42 which are associated with the side walls 36 of the access door 16 are generally L-shaped in cross section. When assembled in the keyhole apertures 41 of the access door 16, a first leg 44 of the glide 42 extends upwardly along the outside of the side wall 36 of the access door 16. The center of this first leg 44 is slotted so that the sides of the first leg 44 can be squeezed together for insertion of an arcuate retaining segment 45 of the glide 42 into the keyhole aperture 41. A second leg 46 of the glide 42 extends substantially perpendicularly to the first leg 44 and, in the assembled posture, lies under the bottom peripheral lip or edge 40 of the access door 16. Thus, when the access door 16 is placed in the rectangular depression 24 of the top cover 15, the first leg 44 of the glides 42 will contact the side walls of the depression 24 and the second leg 46 of the glides 42 will contact the guideways 25 as shown in FIGS. 2, 3 and 6.

Referring again to FIGS. 2 and 3, there is shown a sheet metal bridge 49 which extends from side to side across the rear of the top cover 15. The bridge 49 is mounted on raised segments 50 at each side of the top cover 15 for positioning the front edge 51 of the bridge 49 slightly above the rear of the access door 16 as shown in FIG. 3. The bridge 49 is secured to the raised segments 50 through a plurality of weld studs 52 which extend through the raised segments 50 and which receive push-on or threaded fasteners (not shown) on the back side of the top cover 15. As can be seen in FIG. 3, when the splash guard 30 is secured to the top cover 15, the sliding access door 16 is operably positioned in the depression 24, and the bridge 49 is secured, the access door 16 will be non-removable. The bottom lip or edge 40 at the rear of the access door 16 will engage that portion of the front wall 31 of the splash guard 30 which extends upwardly and the front edge 51 of the bridge 49 will engage with the top of the access door 16 if an attempt should be made to remove it. The access door 16 may be removed from the rectangular depression 24 for servicing by first removing the bridge 49 from the top cover 15.

With the access door 16 placed in the guideways 25 of the rectangular depression 24, the access door 16 is manually slidable by the handle 43 from a forward or closed position to a rearward or open position for providing access to the interior of the tub 29 of the washing machine 12. As best shown in FIG. 3, one side wall 53 of the rectangular depression 24 includes an opening 54 through which the roller actuator 55 of a double pole line switch (not shown) extends for contact with the side 36 of the access door 16. When the access door 16 is in the closed position the switch is configured so that line current is available to the drive motor and controls. When the access door 16 is in the open position, the switch is configured so that line current to the drive motor is broken and current is provided to a light (not shown) for illuminating the interior of the washing machine 12.

Figure 5:
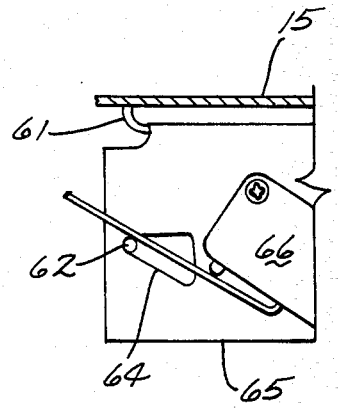
FIG. 5 is a fragmentary section view taken generally along lines 5—5 of FIG. 4 and also shown out of order on sheet 1.

FIGS. 2, 3 and 4 in combination show a solenoid operated catch and latch arrangement 56 for locking the access door 16 in the closed posture during a cycle of operations. The right front corner of the access door 16 includes a hook-shaped catch 59 which extends through a slot 60 in the forward wall of the rectangular depression 24 when the access door 16 is in the closed position. Mounted under the top cover 15 and adjacent the rectangular depression 24 on suitable bracketry 61 is a latch 62 which is actuated by a solenoid 63. As best shown in FIG. 4, the latch 62 is movable from the unlatched broken line posture to the latched full line posture through a cam arrangement 64 as shown in FIG. 5 and which is associated with a wall 65 of the bracketry 61. The posture of the end of the latch 62 in FIG. 5 corresponds to the unlatched broken line posture of FIG. 4. As the solenoid 63 is energized, the end of the latch 62 will follow the slope of the cam arrangement 64 until the opposite end of the latch 62 contacts and follows the body of the catch 59. This corresponds to the full line posture of the latch 62 in FIG. 4. As the latch 62 follows the body of the catch 59 it will be drawn toward the actuator of the switch 66 to close the switch 66 and signal the washing machine control that the access door 16 has been closed and locked.

It can thus be seen that the instant invention provides an improved top cover assembly for the washing machine of a stacked laundry pair. The sliding access door incorporated in the top cover assembly provides a unique construction where the access door slides beneath the dryer cabinetry allowing access to the interior of the washing machine tub. Further, the sliding access door construction provides an assembly whereby the access door is made non-removable from the top cover of the washing machine.

In the drawings and specification, there has been set forth a preferred embodiment of the invention and although specific terms are employed these are used in a generic and descriptive sense only and not for purposes of limitation. Changes in the form and proportion of parts as well as the substitution of equivalents are contemplated as circunstances may suggest or render expedient without departing from the spirit or scope of the invention as further defined in the following claims.

We claim:

1. The combination including a top cover assembly for a washing machine and comprising: a horizontally disposed top cover associated with said washing machine and defining an access opening in said top cover for providing access to within said washing machine; means defining guideways at the sides of said access opening; access door means cooperable with said guideways for forward and rearward sliding movement to close said access opening in a first forward posture and to uncover said access opening in a second rearward posture; and panel means for limiting movement of said access door means and including a first portion fixed to said top cover generally below said access door means and at least partially restricting said access opening.

2. The combination as defined in claim 1 wherein said first portion of said panel means comprises shield means generally disposed to the rear of said access door means in said first posture thereof and includes a front shoulder portion substantially aligned with a front flange of said access door means for engagement therewith in said second posture thereof.

3. The combination as defined in claim 2 wherein said panel means includes a second portion comprising a bridge member extending over a rear portion of said access door means in close juxtaposition thereto and cooperable with said shield means for preventing removal of said access door means from said top cover assembly.

4. A combination appliance having a washing machine and a separately operable dryer disposed above the washing machine wherein the washing machine and dryer are separately supported in a generally mating relationship to provide the characteristics of a unitary appliance, the comprising: a horizontally disposed top cover associated with said washing machine and defining an access opening to within said washing machine, said top cover including means defining guideways at the sides of said access opening; access door means cooperable with said guideways for sliding movement to close said access opening in a first forward posture and to uncover said access opening in a second rearward posture, means on said top cover for effectively retaining said access door means in said guideways in said first forward posture and providing a housing for said access door means in said second rearward posture.

5. In a combination appliance having a dryer disposed above a washing machine at a rear portion thereof, the combination comprising: a horizontally disposed top cover associated with said washing machine and defining an access opening in said top cover for providing access to within said washing machine, said top cover defining a recess having guideways at the sides of said access opening; access door means disposed in said recess for forward and rearward sliding movement to close said access opening in a first forward posture and to uncover said access opening in a second rearward posture, shield means fixed to said top cover generally below said access door means and at least partially over said access opening and including means for limiting movement of said access door means; and bridge means spanning said recess and extending over a rear portion of said access door means in close juxtaposition thereto and cooperable with said shield means for preventing removal of said access door means from said recess.

6. A top cover assembly for a washing machine in a combination appliance having an elevated dryer supported on a stand and a washing machine movable into a position disposed at least partially under the dryer, the combination comprising: a horizontally disposed top cover associated with said washing machine in closely spaced juxtaposition to said dryer and defining an access opening in said top cover for providing access to a washing container of said washing machine, said top cover defining a recess having guideways at the sides of said access opening; access door means disposed in said recess for forward and rearward sliding movement to close said access opening in a first forward posture and to uncover said access opening in a second rearward posture; shield means fixed to said top cover generally below said access door means and at least partially over said access opening and including means for limiting movement of said access door means; and bridge means fixed to said top cover and spanning said recess at a rear portion of said access door means in close juxtaposition thereto and cooperable with said shield means for preventing removal of said access door means from said recess, said bridge means being imperforate and spaced from and independent of a lower panel of said dryer positioned thereabove for enclosing the rear portion of said top cover when not disposed under said dryer.

* * * * *